US008398064B2

(12) United States Patent
Stauber

(10) Patent No.: US 8,398,064 B2
(45) Date of Patent: Mar. 19, 2013

(54) APPARATUS FOR, AND METHOD OF, INSERTING FLAT OBJECTS INTO A FOLDED PRINTED PRODUCT

(75) Inventor: Hans Ulrich Stauber, Grut (CH)

(73) Assignee: Ferag AG, Hinwil (CH)

( * ) Notice: Subject to any disclaimer, the term of this patent is extended or adjusted under 35 U.S.C. 154(b) by 77 days.

(21) Appl. No.: 12/993,636

(22) PCT Filed: May 25, 2009

(86) PCT No.: PCT/CH2009/000176

§ 371 (c)(1),
(2), (4) Date: Jan. 7, 2011

(87) PCT Pub. No.: WO2009/143645

PCT Pub. Date: Dec. 3, 2009

(65) Prior Publication Data

US 2011/0109031 A1 May 12, 2011

(30) Foreign Application Priority Data

May 26, 2008 (CH) ..... 788/08

(51) Int. Cl.
*B65H 39/06* (2006.01)
*B65H 29/04* (2006.01)

(52) U.S. Cl. ..... 270/52.27; 270/52.23; 270/52.29

(58) Field of Classification Search ..... 270/52.16, 270/52.23, 52.25, 52.27, 52.19
See application file for complete search history.

(56) References Cited

U.S. PATENT DOCUMENTS

| | | | | |
|---|---|---|---|---|
| 5,165,672 | A * | 11/1992 | Backman | 270/52.22 |
| 5,269,504 | A * | 12/1993 | Backman | 270/52.2 |
| 5,354,043 | A * | 10/1994 | Reist | 270/52.27 |
| 5,388,816 | A * | 2/1995 | Petersen | 270/52.23 |
| 5,551,682 | A * | 9/1996 | Luthi | 270/52.18 |
| 7,661,665 | B2 * | 2/2010 | Egli | 270/52.17 |
| 7,802,780 | B2 * | 9/2010 | Mader et al. | 270/52.25 |
| 8,091,880 | B2 * | 1/2012 | Honegger | 270/52.25 |

* cited by examiner

*Primary Examiner* — Patrick Mackey
(74) *Attorney, Agent, or Firm* — Rankin, Hill & Clark LLP

(57) ABSTRACT

A device and a method for inserting flat objects into a folded printed product, wherein the products are held by grippers of a gripper conveyor which opens only briefly for inserting the flat object. In order to also stabilize the product in the open state of the gripper, a support element is provided, which moves between the two product parts before the gripper opens and rests on one of the product parts. If the orientations of the support elements and the grippers are selected in a suitable fashion, this will suffice in order to position the product and keep it open such that the flat object can be inserted and the gripper can then be closed again, while clamping the product with the flat object into position. Optionally, further support elements are present, which additionally support the product from the outside, such as the folded edge.

16 Claims, 6 Drawing Sheets

Fig.5
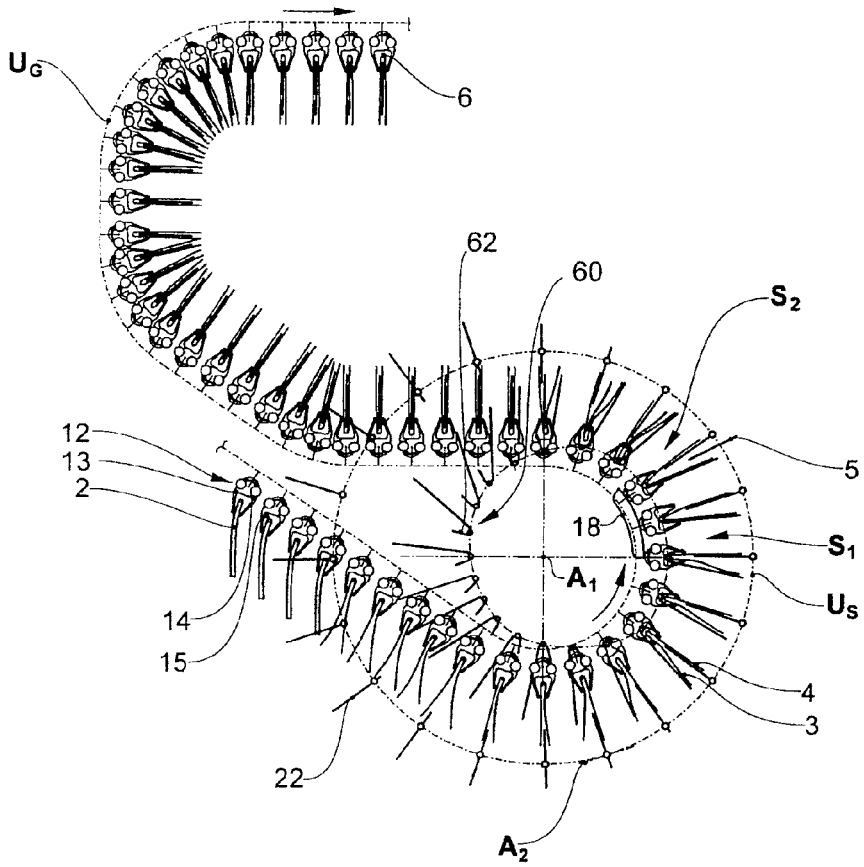
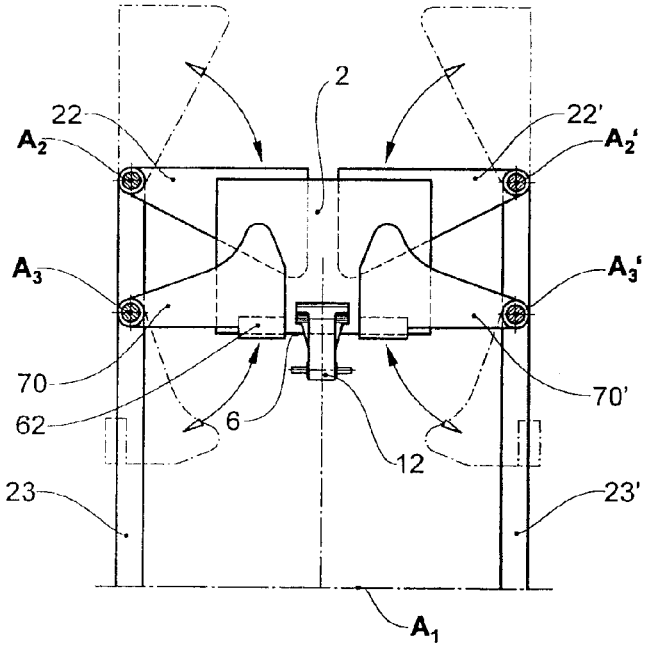
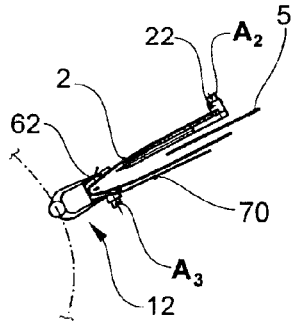
Fig.6

APPARATUS FOR, AND METHOD OF, INSERTING FLAT OBJECTS INTO A FOLDED PRINTED PRODUCT

BACKGROUND OF THE INVENTION

1. Field of the Invention

The invention belongs to the field of the further processing of printed products and relates, in particular, to an apparatus for, and a method of, inserting flat articles into a folded printed product. Examples of such flat articles are printed products, printed sub-products or additional products, newspaper sections, trade samples, leaflets, flyers and other inserts.

2. Description of Related Art

For the purpose of inserting flat articles between the two product parts of a folded printed product, it is known for the printed products coming from the rotary printing machine to be transferred to a separate apparatus, to be retained and opened therein and for the flat articles to be introduced and for the resulting end product to be removed and conveyed further.

EP-B 0 448 679 discloses a method and an apparatus which are intended for inserting flat articles into a folded printed product and in which the printed products, retained by grippers of a gripper conveyor, are moved to a feed station for the flat articles. In the region of the feed station, the grippers are opened briefly, the flat articles are introduced into the previously opened products, and the grippers are then closed again. They then convey the product, including the article, further without the product having been removed from the gripper. In the open state of the gripper, there is the problem of the products being able to fall out of the gripper. For the purpose of supporting the products, a pocket conveyor is thus provided, and the pockets of this pocket conveyor are moved synchronously to the grippers, in the region upstream and downstream of the feed station, along a path which is parallel to the movement path of the grippers. If the gripper is open, the outer surfaces of the two product parts butt against the respective side surfaces of the pockets. One of the product parts is fixed on the side surface by a clamping element, and therefore the product is held open. The folding edge is supported at all times by a channel-like extension, which is fixed to one of the jaws of the gripper. This means that, in the open state of the gripper, lateral tilting of the product is also prevented. Once the flat article has been introduced and the gripper has been closed, the movement paths of the grippers and of the pockets separate again.

One disadvantage of the known apparatus is that it is not possible to use conventional grippers, and thus known gripper conveyors cannot be used without design adaptations. This is because, in the case of conventional grippers, opening of the gripper would result in the product sliding deeper into the then open gripper mouth and also shifting transversely to the gripper-movement direction. The pockets disclosed in EP-B 0 448 679 have just two lateral supporting walls, but no pocket base, and this configuration makes it unsuitable for supporting the product on the folding edge. The channel makes the grippers of EP-B 0 448 679 much wider than the normal grippers, and this may be disadvantageous, for space-related reasons, for processes taking place upstream or downstream.

A further problem which is not solved by the known apparatus is the adaptation to different product formats. Since the clamping elements are located at the outer ends of the pocket walls, it is only products with a certain length adapted to the pocket size which can be retained.

Finally, the known apparatus has the problem of the grippers having to have a certain minimum spacing in order that the pockets, with their angled apart pocket walls, can be moved inbetween the grippers and the products retained thereby. This means that it is not possible for the products to be conveyed in a close-packed formation in which, for example, the product spacings in the conveying direction are smaller than the product lengths. However, it is precisely this scenario which is typical in the case of known gripper conveyors, and it is for this reason as well that these cannot be used.

Furthermore, EP-B 1 809 557 discloses an apparatus which is intended for inserting flat articles into printed products and in which the printed products likewise remain in the gripper during insertion of the articles. The grippers run around a deflection. In the lower region of the deflection, the folded products are opened in a hanging state by an opening means, wherein the free ends of the products are moved apart from one another. The product edges of respectively adjacent products are jointly clamped together by clamping elements which are moved along at a constant spacing by the grippers in the region of the deflection, and therefore the product is held open even with a change in its orientation. The articles are introduced when the open product is oriented upward; in this state, the gripper is also opened and then closed again in order to retain the product together with the inserted article. The invention has the advantage that the product is well positioned by virtue of the free product edges being clamped firmly. However, the adaptation to different formats involves high outlay, and products with a short length in the axial direction, on account of the constant spacing between the grippers and the clamping elements, have a large opening angle, which can adversely affect sensitive products.

BRIEF SUMMARY OF THE INVENTION

It is therefore the object of the invention to specify a method and an apparatus which are intended for inserting flat articles into folded printed products and which avoid the problems of the prior art. The intention, in particular, is for it to be possible to use conventional gripper conveyors.

According to the invention, the folded products, for the insertion of flat articles, are retained by grippers of a gripper conveyor, wherein the grippers open briefly only for the insertion of the flat article and, otherwise, retain the product securely and convey the same. Transfer to a further conveyor takes place, if appropriate, only following insertion. In order for the product to be stabilized in the open state as well, the invention provides a supporting element which, once the products have been opened, moves inbetween the two product parts and supports one of the product parts. With the orientations of the supporting elements and of the grippers being selected in a suitable manner, this is sufficient to allow the gripper to be opened briefly and closed again, in order for the product to be released briefly and gripped again including the flat article. The flat article can be introduced when the gripper is opened, or just prior to the gripper being opened, and the gripper can then be closed again, with the product and the flat article being clamped firmly in the process. Further supporting elements are optionally present, these supporting the product in addition from the outside, e.g. on the folding edge.

In a further operating mode, the flat articles are inserted directly into empty grippers instead of into folded printed products retained thereby. The supporting elements can be moved relative to the grippers such that they support the flat article over its surface area during insertion into the gripper and can guide the same into the open gripper. The surface of the supporting elements here is in alignment, in the region of the feed station, preferably with the open gripper mouth.

The apparatus according to the invention proceeds, like the prior art, from a gripper conveyor with grippers which can be moved along a closed circulatory gripper path. The circulatory path leads to a feed station for the flat articles and past the same. There is a control arrangement present which is set up such that the grippers are opened at an opening location and are closed at a closing location located downstream, as seen in the movement direction. The location for pushing in the flat articles, this location being predetermined by the position of the feed station, is located between the opening and closing locations of the grippers or just upstream of the opening location, in a region in which the products are already open, but the grippers are not yet open. The products thus remain, with the flat articles inserted, in the gripper. The invention provides a plurality of supporting elements which can be moved along a closed circulatory supporting-element path. The supporting elements can be moved relative to the grippers, at least in a sub-region, i.e. section of the circulatory gripper path, such that they are capable of being moved inbetween the two product parts of the folded printed product and of supporting one of the product parts over its surface area, preferably over a large part or the entire product length between the folding edge and the opposite edge, at least between the opening location and the closing location, that is to say while the gripper is open. This makes it possible for the gripper to be opened, for the purpose of inserting the flat article, without the product falling out or shifting. It is also possible in this way for thin and/or flexible products to be reliably supported and held open without their edges necessarily being clamped firmly. The product is supported, and simultaneously held open, laterally and, depending on the orientation of the supporting element, also along the folding edge, and therefore the flat article can be inserted between the product parts.

In the further operating mode, the supporting elements guide the flat article into the open, empty gripper.

The supporting element is preferably formed and moved such that its leading edge, which is directed towards the gripper, reliably supports relatively small products as well. Its leading edge may be arranged, for example, in the immediate vicinity of the folding edge, in particular parallel to the latter.

The invention can easily be realized on the basis of known gripper conveyors. All that has to be provided is a circulating supporting-element conveyor with a plurality of supporting elements which are moved along a circulatory supporting-element path and the movement of which is synchronized with the gripper movement. The circulating supporting-element conveyor is preferably arranged in a curved part of the circulatory gripper path, for example over a deflection of 180°. This means that the grippers change their orientation along the circulatory path. This advantageously makes it possible to utilize the gravitational force for opening and supporting the product, e.g. in that one of the product parts is retained by the supporting element and the other hangs downward under the action of gravitational force. A similar effect can also be achieved in a rectilinear region of the circulatory path by controlled change in orientation of the grippers.

Printed product is understood to mean any folded product made of a web material. It may be in one or more layers and may also be a relatively complex product which already has one or more sub-products or main products. Flat article is understood to mean any additional product which is intended to be introduced into the folded product, e.g. a printed product in one or more parts (sub-products or main products), a trade sample, a leaflet, a flyer, a data carrier or the like. It is also possible for the folded printed product to be just an envelope into which a flat article in the form of a relatively complex printed product which has been previously put together is introduced. Finally, the printed product may also be constituted by a stack of different products, for example different sub-products, which have been combined beforehand.

In order that the supporting element can be pushed inbetween the two product parts, or into a plane running through the gripper mouth, it is preferably flat. It is also possible to provide two or more supporting elements that cooperate with each other per product which move in together between the product parts and/or support the product from the outside or inside.

In order to make it easier for the supporting elements to be pushed in, it is possible to provide an opening arrangement by means of which the two product parts can easily be lifted off from one another. Such opening arrangements are known per se, e.g. from EP-B 1 809 557, which was mentioned in the introduction.

In addition to the product parts being supported from the inside, i.e. by virtue of the supporting element being pushed inbetween the two product parts, further supporting elements which support the folding edge from the outside may be provided for further stabilization. These are used preferably at least in that portion of the circulatory gripper path in which the grippers are open. The further supporting elements may be stationary or can be moved along in accompaniment. In the latter case, their movement is synchronized with the gripper movement. Supporting elements and further supporting elements preferably cooperate with one another in that they enclose the product from both sides and thus move it into a defined spatial position. It is also possible for the folding-edge-supporting elements, as described in EP-B 0 448 679, which was mentioned in the introduction, to be integrated in one of the gripper jaws.

In the case of flexible products, it is advantageous for the product part which is not supported from the inside to be supported as well. For this purpose, it is possible to provide further supporting elements which support the product part from the outside; for this purpose, it is also possible to use the supporting element which is assigned to the preceding or following gripper, as seen in the conveying direction. This function can be performed by a suitable change in orientation of the grippers (pivotability relative to the circulatory path thereof).

The invention is suitable in particular for inserting various individual or combined printed products into a product, in particular in just a single insertion operation. It can be integrated in an existing gripper conveyor without any major design outlay and is thus a cost-effective alternative to the collecting drums which are known per se. When the insertion function is not in use, passage through the apparatus according to the invention can readily take place without the flat articles being inserted; in this case, the supporting elements are not activated, e.g. they are pivoted away. The same applies to the control arrangement for opening and closing the grippers, it being possible for this control arrangement to be deactivated, and therefore the grippers remain closed. It is likewise possible to use the invention for transferring previously combined products to grippers without insertion into a folded product necessarily taking place.

An aligning function for the lateral alignment of the product, possibly with the article inserted, is realized, preferably in the region in which the grippers are open. The quality of the product conveyed can easily be enhanced as a result. The aligning function is realized, for example, by lateral aligning elements, e.g. accompanying belts or stationary guiding surfaces. The aligning elements can preferably be adapted to different product widths.

The supporting elements are mounted preferably on a conveying means which defines the circulatory supporting-element path. The conveying means is, for example, a rigid body (wheel, spokes of a wheel) which predetermines a circular path or a chain which can be moved, by means of suitable guiding means (e.g. a channel), along a path of any desired shape. The supporting elements can preferably be moved, in particular pivoted, relative to their conveying means. As a result, the supporting elements can be introduced into the spatial region which is covered by the folded printed products, and/or the flat articles for insertion, without the circulatory paths or drive mechanisms of the grippers and of the supporting elements crossing and blocking one another. The circulatory supporting-element path is preferably arranged to the side of the circulatory gripper path, as seen in the conveying direction. It is particularly preferable to provide two circulatory supporting-element paths each with supporting elements which are arranged symmetrically to the two sides of the circulatory gripper path. By virtue of the supporting elements being pivoted relative to their conveying means, the position of the supporting elements relative to the gripper can be particularly straightforwardly changed and alternated between an active, supporting position and an inactive position.

The method according to the alternative operation mode serves for inserting flat articles into an empty gripper which is conveyed along a closed circulatory gripper path to a feed station for the flat articles and past the same. The grippers are opened prior to the feed station being reached, and the flat articles are inserted, fixed by the grippers and then conveyed further. According to the invention, prior to the flat article being inserted, a supporting element is moved relative to the gripper such that the flat article, upon insertion, is supported over its surface area and guided into the open gripper. The supporting element can be moved away from the gripper again following the insertion operation.

BRIEF DESCRIPTION OF THE FIGURES

Examples of the invention will be described hereinbelow and are illustrated in the drawings, in which, purely schematically:

FIG. 6 shows the two product parts being supported from the inside and the outside by supporting elements.

DETAILED DESCRIPTION OF THE INVENTION

Figure 1:
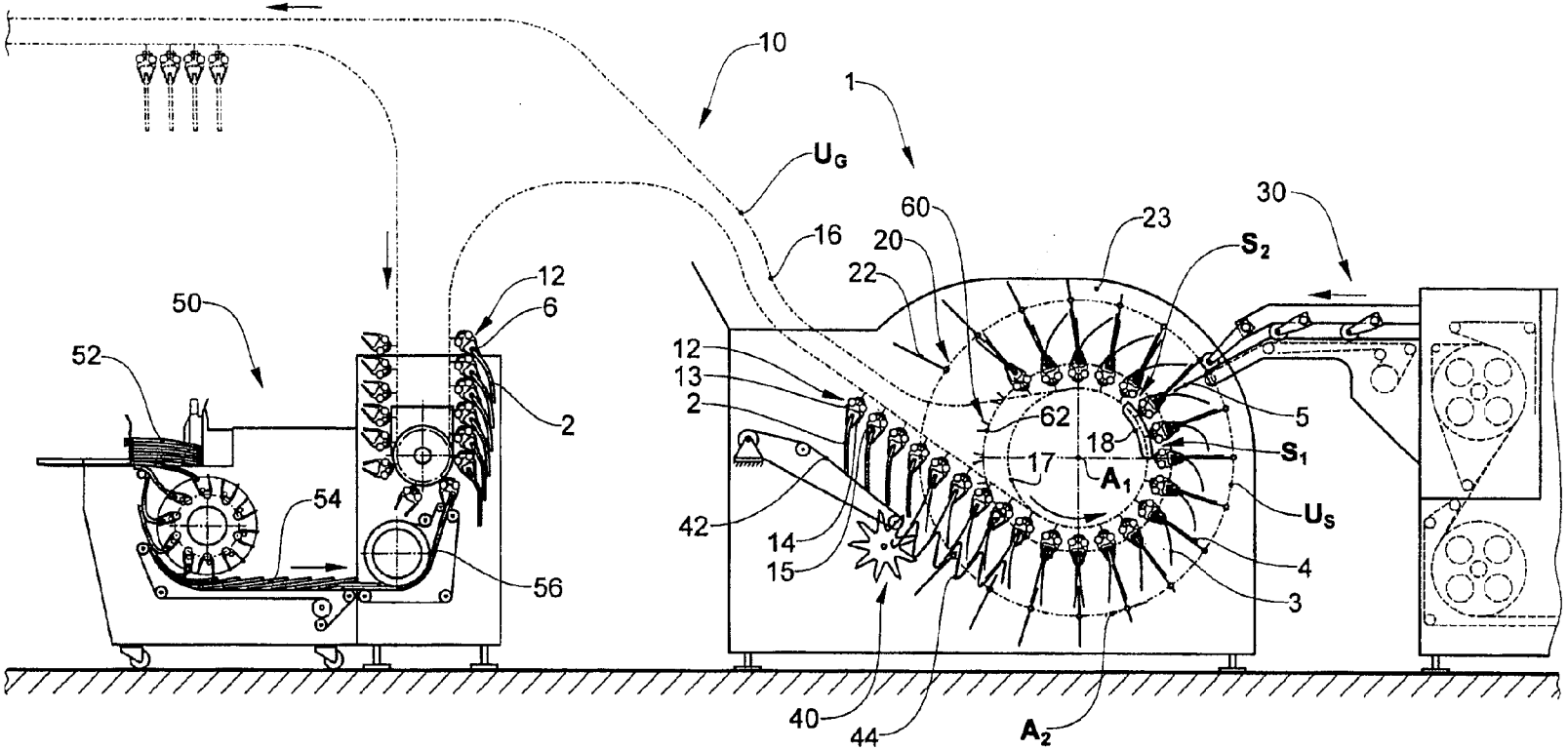
FIG. 1 shows an overview of an insertion apparatus according to the invention.

FIG. 1 shows an overview of a processing and conveying system with an apparatus 1 according to the invention. Individual folded printed products 2 are withdrawn from a stack 52 in a charging station 50, rearranged into an imbricated formation 54 and transferred separately 56 and individually, with the folding edge 6 in front, into grippers 12 of a gripper conveyor 10. The products 2 can also come directly (without interim storage) from a rotary printing machine or can be discharged from an interim store, e.g. a roll; in this case, the charging station 50 is not actuated.

The products 2 may comprise one or more sheets. They may already have flat articles or other additional products. The products 2 are folded once which each have two product parts 3, 4 located one upon the other or one beside the other. The grippers 12 have two gripper jaws 13, 14 which define a gripper mouth 15. They are connected at a constant spacing to a conveying means 16, e.g. a chain guided in a channel, or are moved individually along a guide rail. The path of the conveying means or the guide rail defines a closed circulatory gripper path $U_G$.

The products 2 are conveyed, by the gripper conveyor 10, to a feed station 30 for flat articles 5 and past the same. The feed station 30 supplies the flat articles 5 which are introduced into the open product 2, e.g. by being withdrawn from a stack or an imbricated formation and being accelerated in the direction of the open gripper mouth 15, e.g. according to EP-A 1 475 329. For the purpose of introducing relatively complex flat articles, use can be made, for example, of an apparatus according to WO 2005/118400.

In an alternative operating mode, the grippers 12 do not convey any folded products; rather, the flat articles 5 are introduced into the open, empty gripper at the feed station 30.

In the region of the feed station 30, the circulatory gripper path $U_G$ has a curved, in this case approximately circular, deflection 17, by means of which the grippers 12 are deflected through approximately 180° and, in the process, undergo a change in orientation. In the region of this deflection 17, an opening location S1 and a closing location S2, at which the grippers 12 are respectively opened and closed, are located respectively upstream and downstream of the feed station 30, as seen in the conveying direction. The opening and closing of the grippers is achieved in a manner known per se by means of a suitable control arrangement 18, for example a guide-track control means. Between the opening location S1 and the closing location S2, the flat articles 5 are inserted into the open product 2 or into an empty gripper 12 (as an alternative, the insertion location could also be located upstream of the opening location S1). For this purpose, this product too is opened by an opening means 40 upstream of the opening location S1, as seen in the conveying direction, and held open, and supported, in the manner described hereinbelow.

A plurality of planar, resp. flat supporting elements 22, which in this case are moved in the same direction, synchronously with the grippers 12, in a circulating supporting-element conveyor 20, are located in the region of the deflection 17. The supporting elements 22 have the purpose of moving inbetween the two product parts 3, 4, which are lifted off from one another by the opening means 40, and of supporting the product 2 such that the article 5 can be inserted without the product 2 shifting in an uncontrolled manner. For example, the product is supported such that the gripper 12 can be opened. In the alternative operating mode, the supporting elements 22 move in such that their supporting plane is aligned, for example, with the open gripper mouth, that is to say it runs in a plane which passes through the gripper 12.

The supporting elements 22 are arranged on a conveying means 23 which, in the region of the deflection 17, has a circulatory supporting-element path $U_S$ which is parallel to the circulatory gripper path $U_G$, and in this case is a circular path. The conveying means 23 is realized, for example, by one or more rigid bodies which is or are rotated about an axis A1, e.g. a wheel or a plurality of spoke-like elements. As an alternative, the conveying means may also be a flexible, e.g. rail-guided, drive means. As is evident from FIG. 2, the supporting elements 22 can be pivoted relative to the conveying means 23 about axes A2 which are located perpendicular to the axis A1 and are oriented in the conveying direction. As a result, the supporting elements 22 can be moved in the direction of the gripper mouth 15 and away from the same, that is to say, in the present case, in a movement taking place radially in relation to the circular path, in a plane which is perpendicular to the conveying direction of the grippers 12 or the movement direction of the supporting-element-conveying means 23. This movement of the supporting element is, thus, essentially parallel to the product parts 3, 4 (without taking account of the flexibility inherent therein) and/or to the gripper jaws 13, 14.

Figure 2:
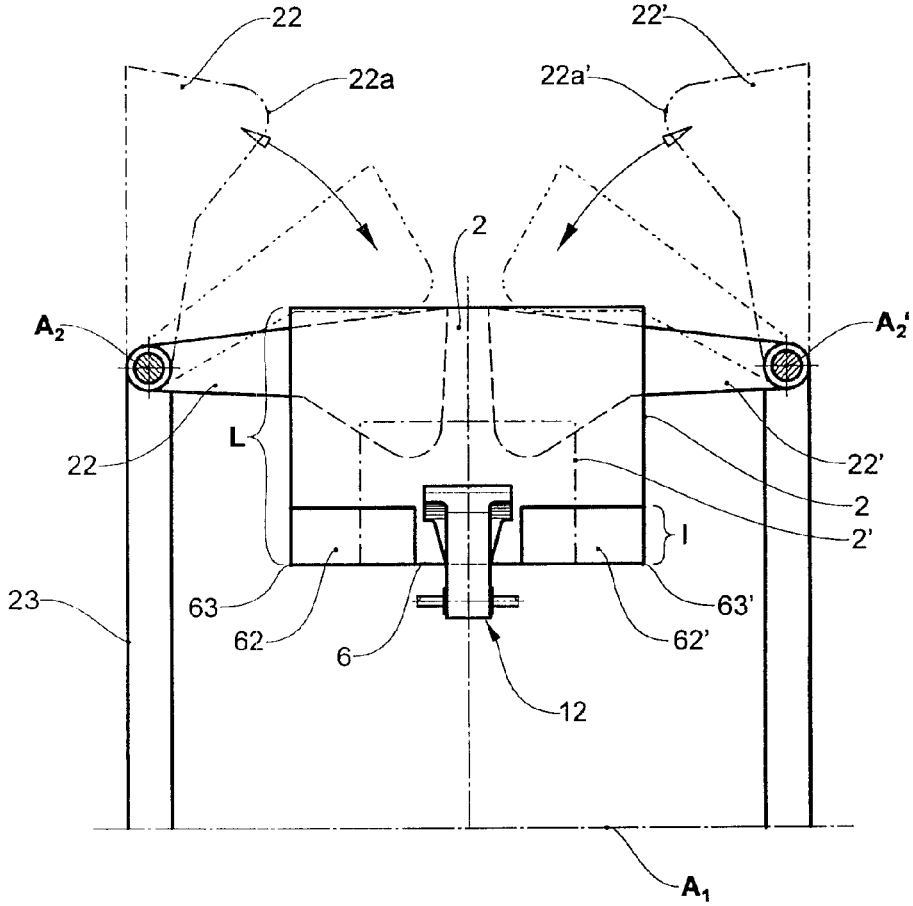
FIG. 2 shows a view of the supporting elements as seen in the conveying direction.

As FIG. 2 shows, two supporting elements 22, 22' are provided for each product 2 or gripper 12, and the pivot axes A2, A2' of these supporting elements are arranged upstream and downstream of the circulatory gripper path $U_G$, as seen in the direction of the axis A1. There are, thus, two circulatory supporting-element paths $U_S$, each with supporting elements 22, 22', arranged symmetrically on both sides of the circulatory gripper path $U_G$. The circulatory paths do not cross, but it is nevertheless the case that the spatial regions which are covered by the supporting elements 22, 22', on the one hand, and the retained products 2, on the other hand, during movement along the circulatory paths $U_S$, $U_G$ overlap.

The supporting elements 22, 22' are flat and are formed such that they widen from the pivot axis A2, A2' in the direction of the distal end. In the inactive state (solid lines, respectively upper position in FIG. 2), the supporting elements 22, 22' run laterally outside the products 2, 2' (2' designates a smaller format). For the purpose of moving inbetween the product parts 3, 4, the supporting elements 22, 22' are pivoted (illustrated by dashed lines) in the direction of the gripper 12, into the active (supporting) position. The curved leading edges 22*a*, 22*a'* of the supporting elements 22, 22' here can be pushed into the gripper mouth 15 and the product 2 can be supported from the inside on or in the region of the folding edge 6. It is also easily possible for products 2, 2' of a different format to be reliably supported by the two supporting elements 22, 22'. The pivoting movement is controlled by a suitable control arrangement, e.g. a guide-track control means.

The circulatory gripper path $U_G$ is formed such that the products 2 are guided tangentially in a hanging state up to the deflection 17 approximately at an angle of 45°. Immediately upstream of the transition into the circular path portion of the deflection 17, the opening means 40 is located beneath the circulatory gripper path $U_G$. The open product edges which are not being held slide, in the first instance, over a conveying belt 42 and are fanned out slightly, and therefore an opening spiral 44 can engage therein and can spread the product parts 3, 4 further apart from one another. In this region, the product stream is guided through, between the laterally swung-out supporting elements 22, 22' arranged on either side. These supporting elements are then pivoted and move in with meshing action between the product parts 3, 4, for example when the associated grippers 12 reach the circular path portion of the deflection 17. Since the supporting elements 22, 22' are always oriented radially in the present example, the leading product part 4, which rests on the supporting element 22, 22' from the outside, is retained in this orientation, while the trailing product part 3 hangs downward under gravitational force. In the immediate vicinity of the feed station 30, the supporting element 22, 22', and thus the leading product part 4, are oriented in an approximately horizontal to slightly upright manner. The gripper 12 is opened and the leading edge of the supporting element 22, 22' is preferably moved into its optimum position—previously determined in accordance with product size/stiffness. The flat article 5 is then introduced, beneath the supporting element 22, 22', into the open product 2 and the open gripper 12, the supporting element 22, 22' is moved out again and the gripper 12 is closed. The products 2 are then moved further in an essentially upright or forwardly inclined state.

In the case of relatively stiff products 2, the above described support provided by the planar supporting element or elements 22, 22' moving inbetween the product parts 3, 4 is sufficient. In the case of more flexible products, it may be advantageous to supplement the support using further supporting elements 62. In the present case, these are moved in a further circulating supporting-element conveyor 60, synchronously with the grippers 12 and the supporting elements 22, 22'. They serve to support the folding edges 6 of the product 2 from the outside, and therefore the products 2 cannot shift even when the gripper is open. As FIG. 2 shows, for this purpose, further, cross-sectionally U-shaped or V-shaped supporting elements 62, 62' are arranged along the axis A1, upstream and/or downstream of the gripper. The bases 63, 63' of these further supporting elements are aligned with one another and with the intended position for the folding edge 6 in the gripper mouth 15. Their width in the direction of the axis A1 is selected such that different formats can be supported; as an alternative, or in addition, the further supporting elements can also be displaced in the direction of the axis A1 for the purpose of format adaptation. The length L of the legs of the further supporting elements 62, 62' is shorter than the spacing between the grippers and the product length L. It is, thus, possible for the further supporting elements 62, 62' to be moved, without any displacement in the radial direction, along a circular path which is concentric with the circulatory gripper path $U_G$ in the region of the deflection 17, respectively with the circulatory supporting-element path $U_S$, and thus to be moved toward the folding edges 6.

Figure 4:
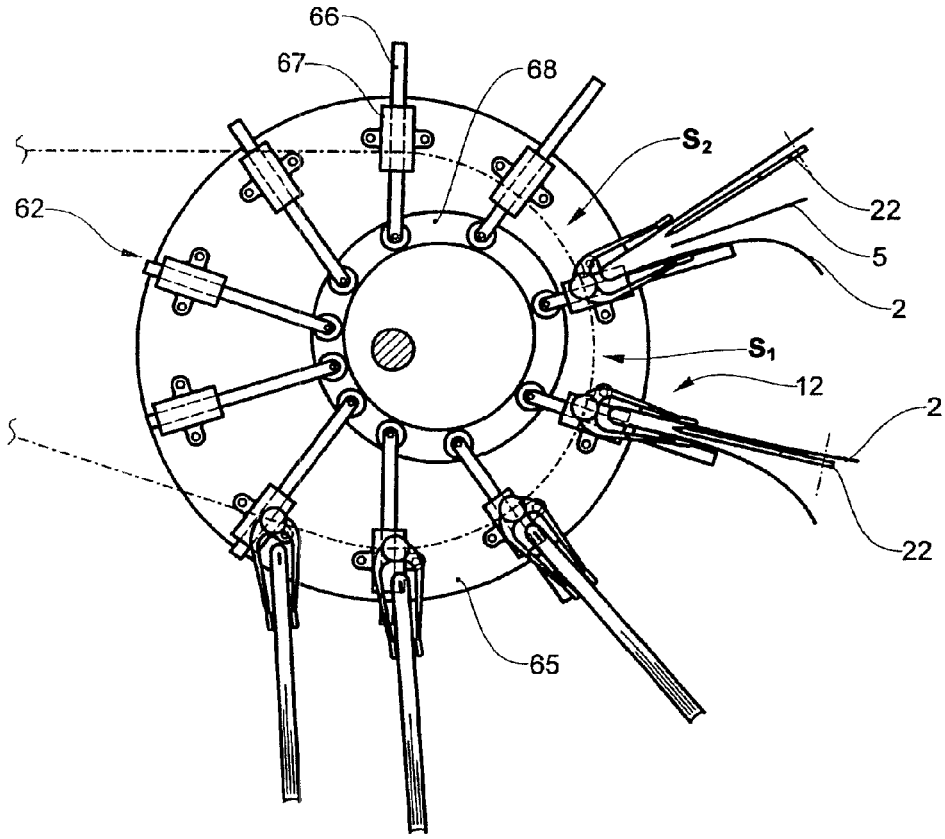
FIGS. 4+5 show two further embodiments of an apparatus according to the invention with further supporting elements.

FIG. 4, which will be described hereinbelow, shows an example with further supporting elements 62 which have a much longer leg, respectively supporting surface and which, for space-related reasons, can be pushed inbetween the grippers 12 or products 2 from the axis of rotation A1.

A preferably format-adaptable aligning station (not illustrated here) for laterally aligning the product along its two side edges in the direction transverse to its current conveying direction is preferably located between the opening and closing locations S1, S2. It would also be possible for aligning elements to be arranged on the supporting elements 22, 22' and to be moved in a controlled manner therewith.

Figure 3B:
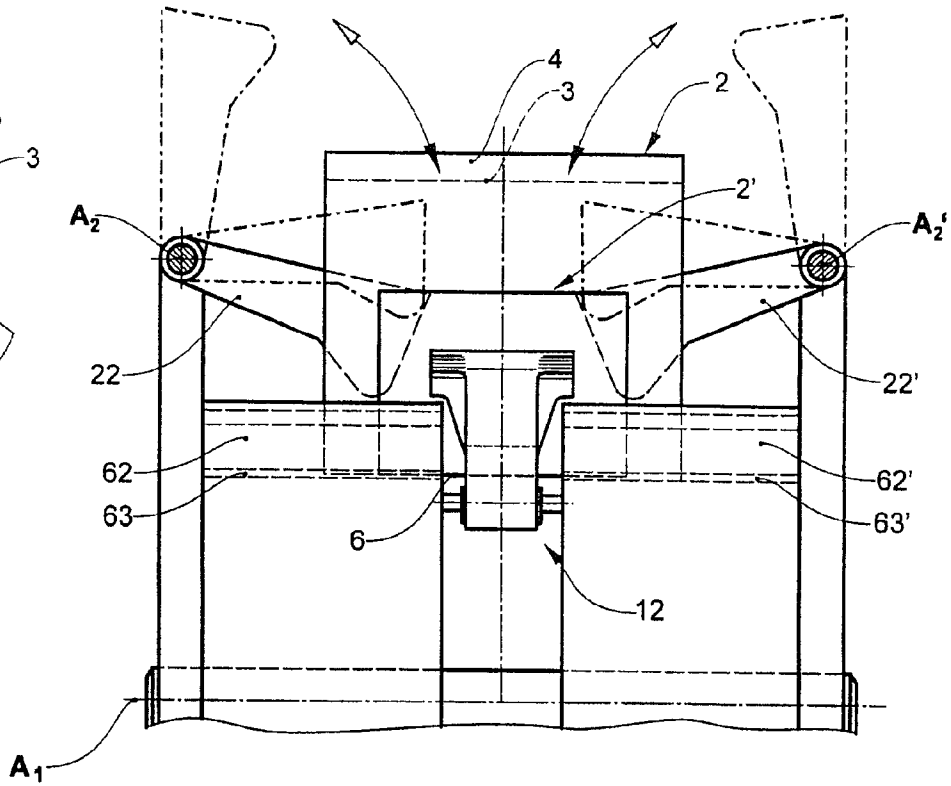
FIGS. 3*a-c* show different variants of the further supporting elements.
Figure 3A:
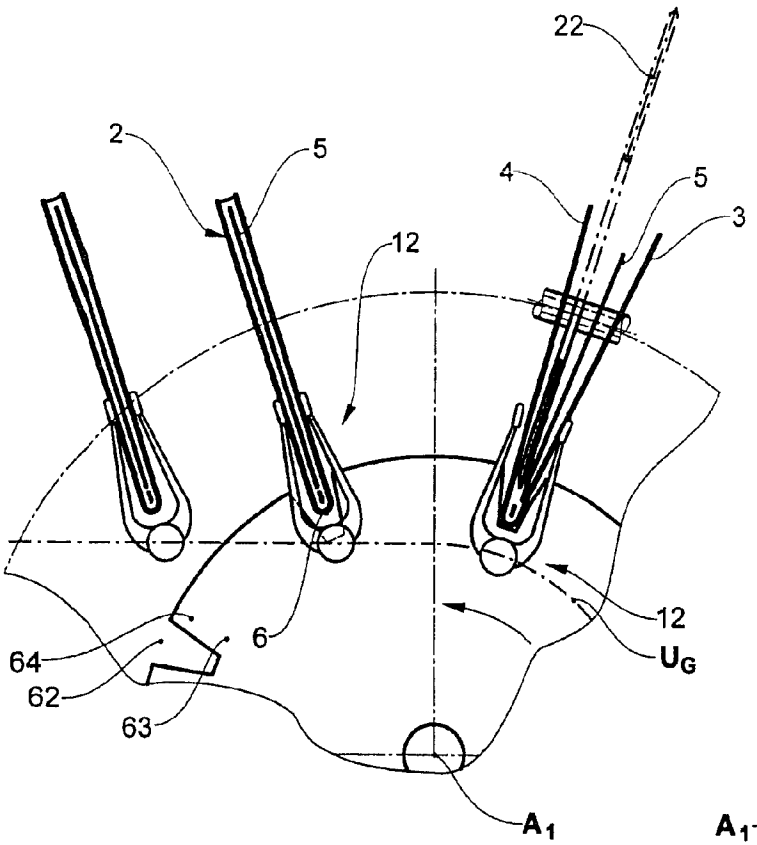
Figure 3C:
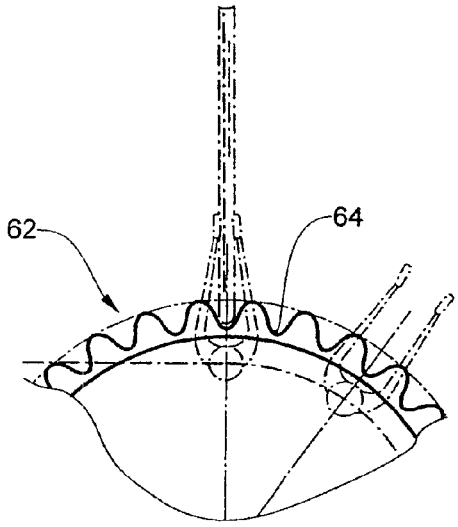

FIGS. 3*a-c* show two alternatives for the further supporting elements 62, 62' for supporting the folding edge 6. In FIGS. 3*a+b*, the further supporting elements 62, 62' are formed by disks which can be rotated about the axis A1. The disks have V-shaped or U-shaped notches 64, the folding edges 6 butting against the bases 63 of these notches. The gripper 12 is shown in the open state in the right-hand part of FIG. 3*a*. The product 2 here is positioned securely by the supporting elements 22, which are introduced between the product parts 3, 4, and the further supporting elements 62, which butt against the folding edge 6 from the outside. The flat article 5 can then be introduced into the open product 2 and the open gripper 12. The left-hand part of FIG. 3*a* shows the gripper 12 in the state in which it has then been closed again, the supporting element 22 having been removed prior to closing. The movement paths of the grippers 12 and of the notches 64 then separate again.

FIG. 3*b* shows a longitudinal section along the axis of rotation A1. For adaptation to different product widths, the two supporting disks 62, 62' can be displaced along the axis A1.

FIG. 3*c* shows an alternative configuration of the further supporting elements 62, in this case in the form of a wheel with a structured outer edge, e.g. an undulating structure or one provided with cross-sectionally. U-shaped grooves. This structure can be realized, for example, by a foam covering with beads. The wheel is rotated synchronously to the grippers as in the case of FIGS. 3*a+b*, the folding edges 6 being positioned in the depressions. It is also possible for a supporting element 62 with a finer structuring, or with an unstructured, but non-slip surface, to be used in order to prevent the folding edges from slipping. It is possible to use, for example, belts with studs, ribs, protuberances, grooves or some other structure.

FIG. 4 shows a further example of an apparatus according to the invention with further supporting elements 62 for supporting the folding edge 6 and the trailing product part 3. The folding edge 6 rests on the outer edge of an outer ring 65 which, as in the above examples, is rotated about the axis A1. The ring has a plurality of radially oriented sleeves 66 which serve for guiding supporting bolts 67 in the radial direction. The supporting bolts 67 are mounted on an inner ring 68, which is arranged eccentrically in relation to the outer ring 65, and therefore they project, depending on the rotary position, to different extents out of the sleeves 66. In the region around the opening and closing locations S1, S2, the supporting bolts 67 have been advanced out of the sleeves 66. The transition between the supporting bolts 67 and the ring 68 defines a channel which serves to prevent the folding edge 6 from sliding off downward. Moreover, the supporting bolts 67 support the trailing product part 3 and the pushed-in flat article 5. This is advantageous, in particular, in the case of thin and/or flexible products.

FIG. 5 shows a further example of an apparatus according to the invention in which the products 2 are supported on their trailing product part 3 from the outside/underneath. The further supporting elements 62, for this purpose, are hook-shaped in cross section and, as in the example of FIG. 4, are moved toward the folding edge 6 from the outside, starting from the center of rotation A1, in order to support the same. Their long leg supports the trailing product part 3.

FIG. 6 shows an example of how the trailing product part 3 can be supported from the outside by supporting elements 70, 70' which are designed in a manner similar to the supporting elements 22 according to FIG. 2. These supporting elements 70, 70' are likewise of planar form, in the manner of a sail, and move inbetween in each case two adjacent products 2. They can be arranged, for example on the same conveying means 23, 23' as the inwardly moving supporting elements 22, 22', such that they can be pivoted about a pivot axis $A_3$ running parallel to the pivot axis $A_2$. The further supporting elements 70, 70' are spaced apart from the supporting elements 22, 22' in the conveying direction (see side view in the right-hand part of FIG. 6) in order for the product 2 to remain open so that the flat article 5 can be pushed in. A folding-edge support 62 may be present in addition, as in FIGS. 2 and 3*a-c*.

The additional supporting elements 70, 70', thus, form a channel, with a long and a short leg, in cross section, as in the example of FIG. 5. The long leg acts as a supporting surface for the trailing product part or for the flat article 5 which is to be inserted (also in the case of insertion into the empty gripper 12). The connecting region between the legs serve as a folding-edge support 62. It is aligned during use, in the region of the feed station, preferably with the gripper mouth.

FIG. 6 shows the inactive positions of the supporting elements 22, 22', 70, 70' using dashed lines and the active positions thereof using solid lines. It can be seen that the gripper 12 with the product 2 retained therein can be moved without obstruction, in the inactive position, through the pivoted-away supporting elements 22, 22', 70, 70' and past the same. In the active position, the spatial regions which are covered by the aforementioned elements overlap, and therefore support can also be provided.

If it is intended to assist only the insertion operation into an empty gripper (without any folded product 2 therein), it may be sufficient for just the lower supporting elements 70, 70' to be pivoted in and for the upper supporting elements 22, 22' to be left in the inactive position. This is because the upper supporting elements 22, 22' serve, in this example, predominantly for opening, and holding open, the product 2 by supporting its leading product part 4 thereof. Upon insertion into the empty gripper, it is important for the article 5 which is to be inserted, in particular, to be supported from beneath, that is to say from the trailing direction, and along the folding edge. This function is performed here by the lower supporting elements 70, 70'.

Figure 7:
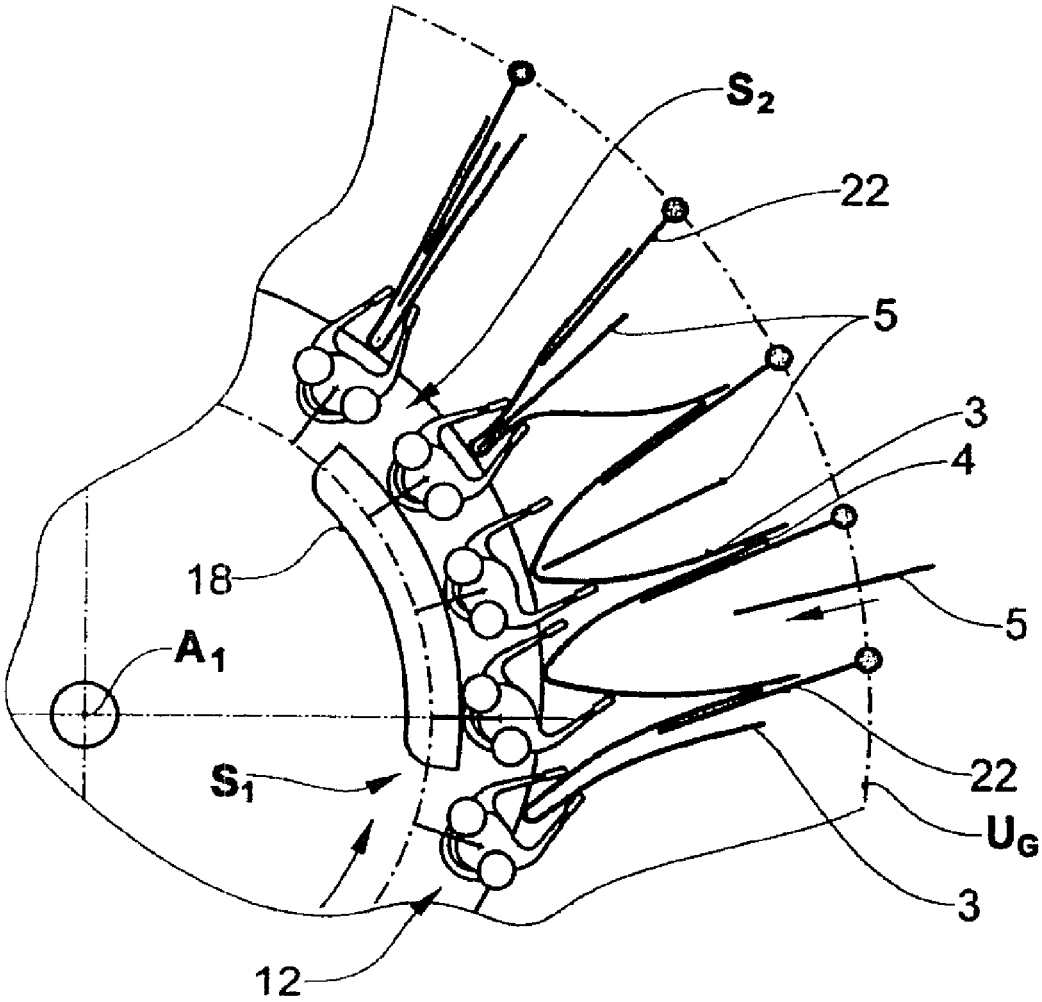
FIG. 7 shows an apparatus according to the invention with pivotable grippers and supporting elements.

Instead of the trailing product part 3, or the article 5 which is to be inserted into an empty gripper 12, being supported by separate supporting elements 70, as in FIG. 6, it can also be supported by the regular supporting element 22 assigned to the following gripper 12, in order that a defined position of the two product parts 3, 4 is achieved when the flat article is introduced. If the gripper spacings are small in relation to the product length, the flexible product parts 3 rest, without any further measures having to be taken, on the following supporting element 22 or on the leading product part 4 of the following product 2. In the case of a less favorable ratio of product lengths to gripper spacing, a supporting function can be achieved by the grippers 12 and the associated supporting element 22 being pivoted in a suitable manner relative to the circulatory path $U_G$. This is shown in FIG. 7. The otherwise radially oriented grippers 12 and supporting elements 22 are pivoted in a conveying direction just upstream of the opening location S1, and therefore the supporting elements 22 support the preceding product 2, which is located in the gripper which is just opening, and the flat article 5 which is to be introduced.

For insertion into empty grippers, it may be necessary for the opening and/or closing locations to be adapted slightly to the grippers. This takes place preferably by way of adjustable control guides.

The invention claimed is:

1. An apparatus for inserting flat articles into folded printed products, comprising:

a gripper conveyor with grippers which can be moved along a closed circulatory gripper path ($U_G$), wherein the circulatory gripper path ($U_G$) leads past a feed station for the flat articles, and comprising a control arrangement for opening the grippers at an opening location (S1) and for closing the grippers at a closing location (S2) located downstream of the opening location (S1), as seen in the movement direction, further comprising a plurality of supporting elements which can be moved along a closed circulatory supporting-element path ($U_S$), wherein the supporting elements can be pivoted relative to the grippers, at least in a section of the circulatory gripper path ($U_G$), such that they are in each case capable of being moved inbetween the two product parts of the folded printed products and thus are capable of supporting one of the product parts over its surface area and of keeping the same open for insertion of the flat articles.

2. The apparatus as claimed in claim 1, wherein the supporting elements are configured and arranged such that, once moved into the printed products, the supporting elements are capable of supporting the printed products essentially over their entire length.

3. The apparatus as claimed in claim 1, wherein the supporting elements, for the purpose of moving inbetween the product parts, are capable of executing a movement, relative to the grippers, of which the movement plane is oriented essentially perpendicular to the circulatory gripper path ($U_G$).

4. The apparatus as claimed in claim 1, wherein the supporting elements are arranged on at least one conveying means which can be moved along the closed circulatory supporting-element path ($U_S$), wherein the circulatory supporting-element path ($U_S$) runs essentially parallel to the circulatory gripper path ($U_G$) at least in the region of the feed station.

5. The apparatus as claimed in claim 4, wherein the supporting elements can be pivoted relative to the conveying means in a plane which runs essentially perpendicular to the circulatory supporting-element path ($U_S$).

6. The apparatus as claimed in claim 4, wherein the conveying means is a body of rotation and the circulatory supporting-element path ($U_S$) is a circular path.

7. The apparatus as claimed in claim 1, wherein the opening location (S1) is located upstream or downstream of the feed station, as seen in the movement direction.

8. The apparatus as claimed in claim 1, further comprising further supporting elements which are capable of supporting the printed products along their folding edge at least between the opening location (S1) and the closing location (S2).

9. The apparatus as claimed in claim 8, wherein the further supporting elements are formed by stationary rests which run preferably on either side of the gripper and define a bearing surface located in the region of the folding edge.

10. The apparatus as claimed in claim 8, wherein the further supporting elements are formed by accompanying elements which preferably have a structuring in the direction transverse to the movement direction, in particular grooves running transversely to the movement direction.

11. The apparatus as claimed in claim 10, wherein the further supporting elements can be moved synchronously with the supporting elements, by means of a common drive.

12. The apparatus as claimed in claim 1, further comprising an aligning unit which is capable of acting, at least between the opening location (S1) and the closing location (S2), on either side of the printed product in order to align the latter in the direction transverse to the movement direction.

13. A method for inserting flat articles into folded printed products, comprising the steps of:

retaining the printed products in the region of their folding edge by grippers of a gripper conveyor, conveying the printed products along a closed circulatory gripper path ($U_G$) to a feed station for the flat articles, opening the printed products prior to reaching the feed station, inserting the flat articles and fixing the printed products with the flat articles inserted therein by the grippers and then conveying further, prior to the insertion of the flat article, pivoting the supporting elements relative to the grippers, and this way moving the supporting elements inbetween the two product parts of the folded printed products, and thus in each case supporting one of the product parts over its surface area and keeping the products open at least until the flat articles are introduced.

14. The method as claimed in claim 13, wherein the supporting element is moved, at least in certain regions, essentially synchronously with the grippers.

15. The method as claimed in claim 13, wherein the printed product, at least in the open state of the gripper, is supported along its folding edge by a further supporting element.

16. The method as claimed in claim 13, wherein that product part of the printed product which is not supported by the supporting element is supported, at least in the open state of the gripper, by a further supporting element.

* * * * *